US007389942B2

(12) United States Patent
Kenyon et al.

(10) Patent No.: US 7,389,942 B2
(45) Date of Patent: Jun. 24, 2008

(54) POP-UP BUBBLER ASSEMBLY FOR DISPENSING FLUID

(76) Inventors: Patrick Kenyon, 74 Timber La., Hilton Head Island, SC (US) 29926; Tu Hung-Chieh, 74 Timber La., Hilton Head Island, SC (US) 29926

( * ) Notice: Subject to any disclaimer, the term of this patent is extended or adjusted under 35 U.S.C. 154(b) by 77 days.

(21) Appl. No.: 11/290,822

(22) Filed: Dec. 1, 2005

(65) Prior Publication Data

US 2007/0125873 A1 Jun. 7, 2007

(51) Int. Cl.
*B05B 12/14* (2006.01)

(52) U.S. Cl. ..... 239/30; 239/24; 239/32; 239/204; 239/288; 239/533.1; 239/533.15; 239/587.1; 285/145.1; 285/145.4

(58) Field of Classification Search ..... 239/24, 239/28, 30, 32, 201, 203, 204, 280.5, 288, 239/533.1, 533.15, 587.1, 205, 206; 285/144.1, 285/145.1, 145.4
See application file for complete search history.

(56) References Cited

U.S. PATENT DOCUMENTS

| | | | | | |
|---|---|---|---|---|---|
| 973,790 | A | * | 10/1910 | Ketih, Jr. | 239/31 |
| 1,019,162 | A | * | 3/1912 | Keith, Jr. | 239/31 |
| 1,044,033 | A | | 11/1912 | Dunphy | |
| 1,751,723 | A | * | 3/1930 | Borgeson | 239/205 |
| 1,882,922 | A | * | 10/1932 | Robinson et al. | 239/204 |
| 3,955,764 | A | * | 5/1976 | Phaup | 239/206 |
| 4,630,569 | A | * | 12/1986 | Dieleman | 239/204 |
| 5,423,486 | A | | 6/1995 | Hunter | |
| 6,530,531 | B2 | | 3/2003 | Butler | |
| 2005/0023370 | A1 | | 2/2005 | Hong | |
| 2005/0023378 | A1 | | 2/2005 | Gregory et al. | |

* cited by examiner

*Primary Examiner*—Steven J Ganey
(74) *Attorney, Agent, or Firm*—Welsh & Flaxman LLC

(57) ABSTRACT

A pop-up bubbler assembly for drinking fountains or other appliances that includes a head with a dispensing spout that rises upward out of a housing to dispense an arc of clean water when activated. The bubbler head then drops back down into the housing after water flow stops such that the dispensing spout is covered when not in use.

13 Claims, 2 Drawing Sheets

FIG. 1
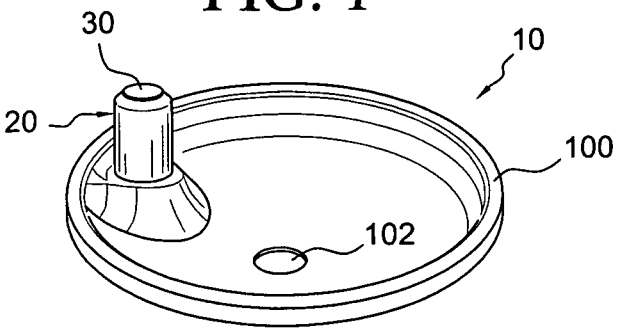
FIG. 2
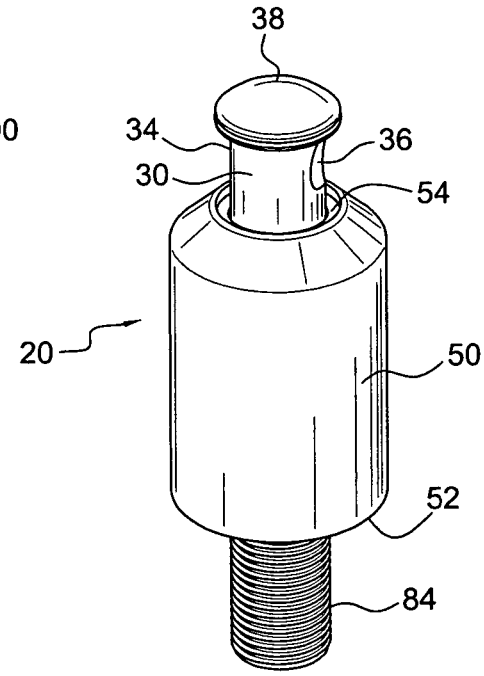
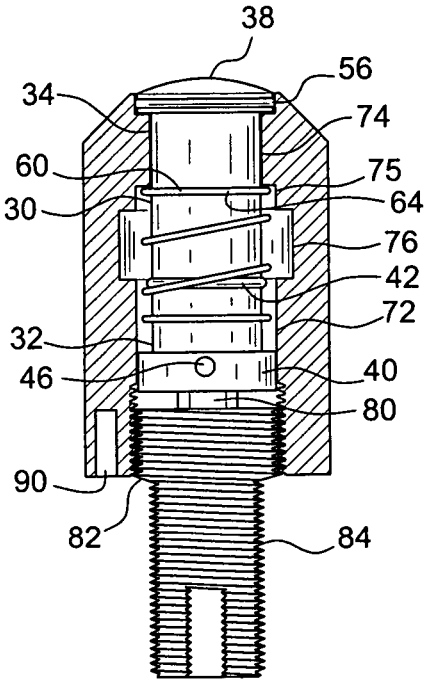
FIG. 3
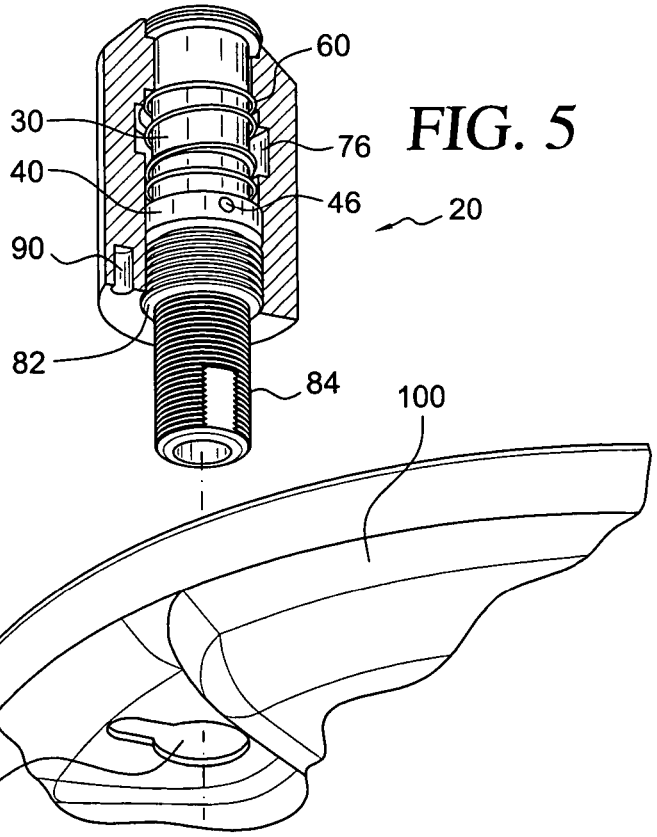
FIG. 5

POP-UP BUBBLER ASSEMBLY FOR DISPENSING FLUID

BACKGROUND OF THE INVENTION

1. Field of the Invention

The invention relates to a pop-up bubbler assembly for dispensing water. More particularly, the invention relates to a water dispensing assembly for a drinking fountain wherein a bubbler head rises upward out of a housing to dispense an arc of clean drinking water when activated. The bubbler head then drops back down into the housing after water flow stops such that the dispensing nozzle is covered when not in use. It is further contemplated the pop-up bubbler assembly could be used to dispense water into bathtubs and sinks.

2. Description of the Prior Art

Regrettably, while drinking fountains provide desirable refreshment, the potential for contamination is great. Contaminants may easily settle on the bubbler head through which water is emitted and be passed to an individual during use. Suffice to say that some level of protection from contamination is highly desirable.

The traditional mechanics of a drinking fountain are simple, well known, and well understood. A drinking fountain produces a controlled delivery of fluid upon activation by an individual in need of liquid refreshment. Activation is achieved through a turn valve, lever valve, or pushbutton valve connected to a drinkable water supply. When activated, water is emitted from a bubbler head fixedly mounted to a drain bowl or basin until the valve is released. The water is projected in a parabolic stream from the bubbler head to the bowl allowing the individual to drink from the emitted stream. Any excess water is received in the bowl and encouraged by the shape of the bowl to enter a drainage system. Most drinking fountains are not cleaned on a regular basis leaving the movement of the water as the only force fighting contamination.

Contamination of drinking fountains may occur in any number of ways. For one, airborne pathogens common in nearly every environment may land on the drinking fountain. In other instances the environment itself contributes undesirable contaminants. This can be seen where a fountain is near construction that might emit harmful debris. Similarly, outdoor fountains located adjacent any form of maintained park land, golf course, lawn or garden are subject to exposure to chemicals and unclean water sources used in the greens keeping.

It has been found that contamination of drinking fountains may be limited through the implementation of movable drinking fountain components. While this does not eliminate all contaminants, the protective effects of movable drinking fountain components can be highly desirable. One approach has been use of a vertically movable water delivery part for presentation of the outpouring water suitably high and convenient to be taken in the mouth. This is illustrated in U.S. Pat. No. 1,044,033 to Dunphy. The water delivery part descends to a lower position to have a place of occupancy in a portion of the fountain in which water is trapped. The delivery portion is thereby always rinsed prior to use.

A similar concept is seen in U.S. Patent Application Publication No. 2005/0023370 to Hong. A pop-up protective cover or cap for preventing bubbler head contact with undesired contaminants is disclosed. The cover normally encloses the bubbler head, but when the water supply is turned on the cover hydraulically rises up to an elevated position allowing for projection of a water stream.

The previous uses of movable bubbler heads or components thereof to limit contamination suffer from several disadvantages. First, those fountains in which the bubbler head is recessed within a pool of water are subject to the contaminants within the water. The bubbler heads on these fountains are continuously subjected to any contaminants within the water supply or provided by the environment. This results in an increase in the likelihood that the contaminants will be passed along to a fountain user or otherwise adversely affect the function of the fountain. Second, those fountains employing movable covers are limited in that their bubbler heads are fixed in a single position. It would be an advantage to have the ability to reposition the bubbler head depending on its use (e.g., depending on height of the user, strength of water pressure, or shape of the drain bowl). Further, a movable cover may retain contaminants underneath it to which the bubbler head is continuously exposed when in an unused position. Ideally, a drinking fountain with the least chance for contamination is most preferred. While the previous attempts for preventing contamination of drinking fountains claim to eliminate contamination, they are limited in the protection provided.

A need, therefore, exists for a pop-up bubbler for a drinking fountain, wherein the bubbler head rises from a housing. The present invention provides such a pop-up bubbler while providing liquid refreshment without contamination.

SUMMARY OF THE INVENTION

It is, therefore, an object of the present invention to provide a pop-up bubbler assembly for drinking fountains or other appliances that includes a head with a dispensing spout that rises upward out of a housing to dispense an arc of clean water when activated. The bubbler head then drops back down into the housing after water flow stops such that the dispensing spout is covered when not in use.

It is another object of the present invention to provide a pop-up bubbler assembly for dispensing a fluid from a bubbler head having a longitudinal bore spaced between a first end and a closed second end and the bore ending in a lateral spout from which fluid is projected, a housing having an upper surface and lower surface and a channel extending therebetween within which the bubbler head is retained to travel between a storage position and an in-use position and upon activation fluid pressure causes the bubbler head to rise from an opening in the channel at the upper surface of the housing to dispense fluid from the spout.

It is a further object of the present invention to provide a bubbler head having a top cap at the closed second end which cooperates with the opening to form a seal between the housing and bubbler head when the bubbler head is in the storage position.

It is also another object of the present invention to provide the top cap with a convex upper surface and the housing with a frustoconical upper surface, such that the top cap convex upper surface is continuous with the upper surface of the housing so as to form a convex surface preventing the pooling of fluid thereon.

It is yet another object of the present invention to provide the bubbler head with an O-ring along its length which cooperates with the channel to form a seal when the bubbler head is in its in-use position.

It is still another object of the present invention to provide the channel with a first section and a second section having a diameter larger than the diameter of the first section and a cavity between the first diameter section and the second diameter section and the cavity having a diameter larger than the diameter of the second section.

It is yet a further object of the present invention to provide the bubbler head with a flange piece and top cap at opposite ends both having diameters larger than the first section diameter, thereby preventing entry of the flange piece and the top cap into the first section of the channel.

It is also a further object of the present invention to provide the bubbler head with a flange piece connected to its first end and the flange piece includes an alignment extension having a shaped circumference and a removable retainer for maintaining the flange piece within the housing of the pop-up bubbler assembly wherein the retainer has an alignment extension receiving hole shaped to match the circumference of shaped alignment extension.

It is still a further object of the present invention to provide the bubbler head with a flange piece having at least one lateral fluid delivery orifice which is only accessible when the flange piece is positioned within the cavity between the first diameter section and the second diameter section.

Another object of the present invention is to provide a spring positioned between the bubbler head and housing to retain the bubbler head within the housing during inactivation of the assembly.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view showing the pop-up bubbler assembly of the present invention mounted to a drinking fountain bowl.

FIG. 2 is an enlarged perspective view of the pop-up bubbler assembly of the present invention.

FIG. 3 is a cross-sectional view of the pop-up bubbler assembly of the present invention.

FIG. 5 is a diagram depicting an embodiment for connecting the pop-up bubbler assembly to the drain bowl.

DESCRIPTION OF THE PREFERRED EMBODIMENT

Figure 4:
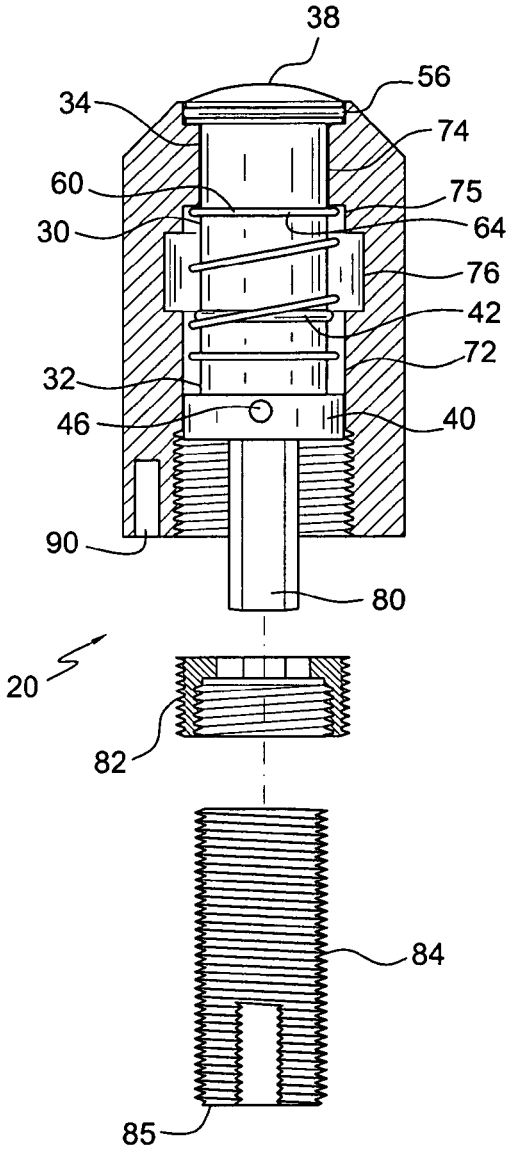
FIG. 4 is a partially unassembled cross-sectional view depicting use of an alignment tool.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for the claims and as a basis for teaching one skilled in the art how to make and/or use the invention.

With reference to the attached drawings, a pop-up bubbler assembly 20 for a drinking fountain 10 is disclosed. The present pop-up bubbler assembly 20 includes a bubbler head 30 having a longitudinal bore 35 spaced between a first end 32 and a closed second end 34 and ending in a lateral spout 36 from which water is projected. The assembly also includes a housing 50 having a central channel 70. The central channel 70 includes an opening and different diameter sections within which the bubbler head 30 is retained for travel between a storage position and a use position. A spring 60 is positioned between the bubbler head 30 and the housing 50 to retain the bubbler head 30 within the housing 50 during inactivation of the pop-up bubbler assembly 20. Storage of the bubbler head 30 within the housing 50 reduces contamination of the fountain.

The traditional mechanics of a drinking fountain 10 are simple, well known, and well understood. Generally, upon activation, a drinking fountain 10 controls delivery of fluid from a water source under pressure in a manner permitting an individual to drink. Although a water source is disclosed in accordance with a preferred embodiment of the present invention, various fluid sources may be used without departing from the spirit of the present invention. A control valve connected to a drinkable water source is activated to emit the fluid from a bubbler head assembly 20 fixedly mounted to a drain bowl or basin 100 until the control valve is released. The fluid is projected in a continuous parabolic stream from which the individual may drink. Excess fluid is caught within the drain bowl or basin 100 causing it to enter a drainage system.

The present invention promotes a reduction in contamination by providing a pop-up bubbler assembly 20 including a bubbler head 30 that moves between a storage position where the bubbler head 30 is hidden from the external environment by positioning it in the housing 50 and an in-use position where the bubbler head 30 is extended from the housing 50 for dispensing water. Movement of the bubbler head 30 within the housing 50 is controlled by fluid pressure generated by the water source and the bias of a spring 60.

Generally, and as will be discussed below in greater detail, FIG. 1 is a diagram depicting a drinking fountain 10 including a pop-up bubbler assembly 20 with the bubbler head 30 in its storage position in accordance with the preferred embodiment of the present invention. FIG. 2 shows the pop-up bubbler assembly 20 with its bubbler head 30 in its use position in accordance with the preferred embodiment of the present invention.

More particularly, the bubbler head 30 includes an elongated cylindrical body with a central fluid passageway 35 extending therethrough (shown in broken lines). The bubbler head 30 includes a threaded inlet first end 32, a second closed end 34 and an outlet spaced below the second closed end to form a spout 36. The point at which the fluid passageway 35 exits the bubbler head 30 defines the spout 36 from which fluid exits the bubbler head 30. The fluid passageway 35 extends from the inlet first end 32 to the spout 36 defining a path for fluid coming from a pressurized water source, extending through the bubbler head 30 and exiting at the spout 36 for consumption or dispensing into a basin by individuals using the present pop-up bubbler assembly 20.

The bubbler head 30 includes a top cap 38 at its second end 34 opposite the threaded inlet first end 32 and an outwardly extending flange piece 40 connected to end 32. The flange piece 40 includes a male threaded section 45 which cooperates with female threads 37 in fluid passageway 35 at its first inlet end 32. The dispensing spout 36 of the bubbler head 30 is in the form of an upwardly angled bore running from the interior of the bubbler head 30 to the exterior. The angle of the bore can vary and depends upon the parabolic fluid dispensing path one desires to achieve.

The bubbler head 30 is contained within a cylindrical housing 50 shaped and dimensioned to support the bubbler head 30 while permitting movement of the bubbler head 30 relative to the housing 50. Movement of the bubbler head 30 within the housing 50 is controlled by a series of interacting components and a spring 60 biasing the bubbler head 30 toward its storage position. With this in mind, and as will be discussed below in greater detail, the bubbler head top cap 38 and the flange piece 40 are of a greater diameter than the remainder of the bubbler head 30 along its length. The enlarged top cap 38 facilitates sealing of the bubbler head 30 and controlled downward movement of the bubbler head 30, while the flange piece 40 is shaped and dimensioned to center the bubbler head 30 within the housing 50 and create hydraulic pressure causing upward movement of the bubbler head 30.

In practice, activation of the fountain 10 creates sufficient fluid pressure to overcome the force of the spring 60 and pushes the bubbler head 30 out of the housing 50 to its use position. Fluid flow is created through the activation of a control valve (not shown) in a conventional manner. Once the bubbler head 30 reaches a height at which the bubbler head 30 spout 36 clears the housing 50, fluid is projected from the spout 36 in traditional fashion. The fluid travels from a drinkable water source to the bubbler head 30 where it is dispensed in a parabolic path to the drain bowl 100. Any unconsumed fluid is delivered to the drain bowl 100 where it is directed, due to the bowl's 100 concave shape, to a drainage system through a drain hole 102. When activation ceases, the control valve is released and the flow of fluid from the water sources ceases, the fluid pressure decreases within the pop-up bubbler assembly 20 and the force of the spring 60 causes the bubbler head 30 to return to its storage position in the housing 50.

As briefly mentioned above, the elevation of the bubbler head 30 from its storage position within the housing 50 is due to hydraulic pressure generated when the control valve is activated and water pressure is applied to the flange piece 40 at the first inlet end 32 of the bubbler head 30. The spring 60 is positioned between the bubbler head 30 and the housing 50 in a manner which retains the bubbler head 30 within the housing 50 in its storage positioned prior to activation. More specifically, the spring 60 includes a first end 62 and a second end 64. The first end 62 engages the flange piece 40 formed at the first inlet end 32 of the bubbler head 30, while the second end 64 of the spring 60 engages lower rim 75 of the upper section 74 at channel 70 and abuts thereagainst during operation. More particularly, and in accordance with a preferred embodiment of the present invention, the spring 60 surrounds the bubbler head 30. In this way, the second end 64 of the spring 60 is held in position, against lower rim 75 of section 74 while the first end 62 of the spring 60 applies a downward force upon the flange piece 40 of the bubbler head 30 causing the bubbler head 30 to move downwardly when fluid pressure is not overcoming the bias of the spring 60.

As those skilled in the art will certainly appreciate, the rate of ascension of the bubbler head 30 is controlled due to the spring constant of the spring 60. As such, springs 60 of various strengths may be selected to suit the water pressure of the locality in which the present invention is employed.

The downward bias of the spring 60 draws the top cap 38 of the bubbler head 30 into a tight seal with the rim 54 at the opening of the central channel 70 of the housing 50. The bubbler head 30 is, therefore, contained within the housing 50 whenever the drinking fountain 10 is not in use, thereby limiting exposure to contaminants. The top cap 38 includes an O-ring 56 which further aids in providing a tight seal with the rim 54 recessed in upper surface 53. The upper surface of the top cap is convex and continuous with the upper frustoconical surface 53 of housing 50 when in the storage position.

The housing 50 is cylindrical, although those skilled in the art will appreciate that a variety of shapes could be employed without departing from the spirit of the present invention. The housing 50 includes a frustoconical upper surface 53 with a recessed rim 54 and a bottom end 52. A central channel 70 extends along the length of the cylindrical housing 50 between the upper surface and bottom end 52. Interaction of the bubbler head 30 with the central channel 70 and rim 54 of the housing 50 helps to control movement of the bubbler head 30 between its in-use position and its storage position. With this in mind, the central channel 70 has different diameter sections along its length. The upper surface 53 of the housing 50 is preferably sloped downward and away from the opening of the central channel 70 to draw fluid and/or contaminants away from the pop-up bubbler assembly 20. The bubbler head 30 moves within the central channel 70 during operation of the drinking fountain 10. While at rest, the bubbler head 30 sits within the central channel 70 of the housing 50 in a storage position. The top cap 38 of the bubbler head 30 is dimensioned to cooperate with the rim 54 at the opening of the housing's central channel 70 to prevent the bubbler head 30 from descending beyond the rim 54 of the housing 50 while forming a seal between the housing 50 and the top cap 38.

The bubbler head 30 is positioned within the central channel 70 formed in the housing 50 and is slidably moveable therein. The central channel 70 includes a lower section 72 slightly greater than the diameter of the bubbler head 30 flange piece 40 for permitting movement of the bubbler head 30 within the central channel 70 and an upper section 74 smaller than the diameter of both the top cap 38 and the flange piece 40. Movement of the bubbler head 30 through the upper section 74 is thereby bounded by the bubbler head top cap 38, as it forms a seal with the housing 50, and the bubbler head 30 flange piece 40 whose diameter prevents movement into the upper section 74. A cavity 76 is formed within lower section 72 of the central channel 70 at a position spaced slightly below the meeting point of upper section 74 and lower section 72 of the central channel 70. This cavity 76 is greater in diameter than the bubbler head flange piece 40 and provides a passageway for water when the bubbler head 30 ascends beyond a desired level. Upon activation and reaching the elevated position wherein the flange piece 40 is aligned with the cavity 76, the water pressure will equalize with the spring 60 bias and the bubbler head 30 is lifted due to hydraulic pressure with the flange piece 40 resting aligned with the cavity 76.

As noted above, the bubbler head top cap 38 is dimensioned to prevent its descent beyond the opening at the top end rim 54 of the housing 50. In a similar fashion, the ascension of the bubbler head 30 is also limited in height due to the dimensions of the upper first section 74 of the central channel 70 and that of the bubbler head flange piece 40. The diameter of the bubbler head flange piece 40 is greater than the width of the upper section 74 of the central channel 70 preventing movement of the bubbler head flange piece 40 beyond the upper section 74 of the central channel 70.

As discussed above, the bubbler head 30 is propelled in its ascent by the hydraulic pressure delivered from an appropriate drinkable water source. Activation of the control valve releases the fluid to travel into the central channel 70. As the hydraulic pressure within the central channel 70 increases, the bubbler head flange piece 40 is driven upward until it reaches its resting place within the cavity 76, compressing the spring 60 between rim 75 and flange piece 40 in the process. When the control valve is no longer activated, the hydraulic pressure decreases and the force held by the compressed spring 60 causes the spring 60 to expand. The expansion of the spring 60 pushes against the bubbler head flange piece 40 on one end and on rim 75 at its other end resulting in the descent of the bubbler head 30 to its storage position.

Preferably the diameter of the bubbler head flange piece 40 is as close to the diameter of the lower second section 72 of the central channel 70 as possible without losing free movement of the bubbler head 30. Any significant difference in diameter reduces the hydraulic pressure applied to the bubbler head flange piece 40 as the fluid escapes around it. Therefore, little to no fluid is intended to escape around the bubbler head flange piece 40 until it reaches the cavity 76.

The bubbler head flange piece 40 is held in position by the hydraulic pressure as the fluid fills the cavity 76. The fluid is prevented from continuing up the central channel 70 by an O-ring 42 positioned along the bubbler head 30 which forms a seal at the meeting point of the upper first section 74 and the lower second section 72 of the central channel 70 when the bubbler head flange piece 40 is raised reaches the cavity 76. The O-ring 42 is preferably fitted into a retaining groove 44 cut into the outer surface of bubbler head 30 to prevent its dislocation during use of the drinking fountain 10. At least one fluid delivery orifice 46 positioned below the O-ring 42 and within the bubbler head 30 and/or the bubbler head flange piece 40, wherein the orifice 46 is only accessible to incoming fluid upon reaching the cavity 76. While the orifice 46 is positioned within cavity 76 it provides an avenue for escape of the fluid entering under pressure from the fluid supply line 87. Upon entering the delivery orifice 46, the fluid travels the length of the bubbler head 30 fluid passageway 35 until it reaches the bubbler head spout 36 from which it is ejected in a stream.

Force generated by the movement of the water may cause rotation and/or shifting of the bubbler head 30 relative to housing 50. To combat this problem, an alignment extension 80 is used to guide the bubbler head 30 in its ascent and descent. FIG. 4 depicts one embodiment of the present invention where the alignment extension tool 80 is in the form of a tailpiece fixedly attached to the bubbler head flange piece 40. The alignment tool 80 extends downward through a dual threaded retainer 82 in the form of a ring and into a hollow threaded stud 84. Exterior threads on the hollow threaded stud 84 connect with mating threads along the interior of the dual threaded retainer 82. Likewise, exterior threads on the dual threaded retainer 82 connect with mating threads along the bottom of the interior of the lower section 72 of the central channel 70 to maintain flange piece 40 within the channel of the pop-up bubbler assembly 20.

The alignment tool 80 has a circumference shaped to match the shape of a corresponding receiving hole 86 in the retainer 82. The shape of the alignment tool 80 and the corresponding receiving hole 86 is such that rotation is prevented when the alignment tool 80 is passed through the retainer 82. Further, the length of the alignment tool 80 is such that it is not fully withdrawn from the retainer 82 when the bubbler head 30 is in the highest elevated position. Thus, the alignment tool 80 keeps the bubbler head 30 in an upright position throughout operation of the drinking fountain 10 while also preventing rotation thereof.

A retention groove 90 is also used to maintain orientation of the components of the pop-up bubbler assembly 20. It is also contemplated that more than one groove could be employed. Specifically, the retention groove 90 is a receiving hole at the bottom of the housing 50 into which is placed a correspondingly shaped article to prevent movement of the housing 50. In accordance with a preferred embodiment of the present invention, the article is a raised portion of the drain bowl 70 upon which the housing 50 sits. It is contemplated it may also be a separate implement, such as a pin or fastener, without departing from the spirit of the present invention. Where the article is part of the drain bowl 100 itself, the insertion of the article into the retention groove 90 prevents the housing 50 from rotating. Similarly, where the article is a separate implement, the implement is secured to both the retention groove 90 and the drain bowl 100 to prevent rotation of the housing 50.

FIG. 5 illustrates a preferred embodiment for connecting the present pop-up bubbler assembly 20 to the drain bowl 100. As those skilled in the art will certainly appreciate, the drain bowl 100 could also be a bathtub, sink or other structure without departing from the spirit of the present invention. A hollow threaded stud 84 extends downward from the housing 50 for connection to the drain bowl 100. The end 85 of the hollow threaded stud is adapted to be connected to a water supply line 87. A mounting hole 104 in the drain bowl 100 is shaped to accept the hollow threaded stud 84. The mounting hole 104 may include spacing for the separate implement used to prevent rotation of the housing 50 or an additional hole is present for this same purpose. Once passed through the mounting hole 104, the hollow threaded stud 84 is attached to a fluid supply line 87 in a conventional manner. As such, the hollow threaded stud 84 typically includes threads for attachment of a securing nut, a compression fitting, a section upon which a compression fitting may be attached, or a locking female or male piece, etc. In like manner, the separate implement, if one is used, is inserted through the mounting hole 104, as illustrated, or the corresponding additional hole. Therefore, the pop-up bubbler assembly 20 is fixed to the drain bowl 100 by conventional methods of attachment once the hollow thread stud 84 is passed through the mounting hole 104 and securely held in place.

Figure 6:
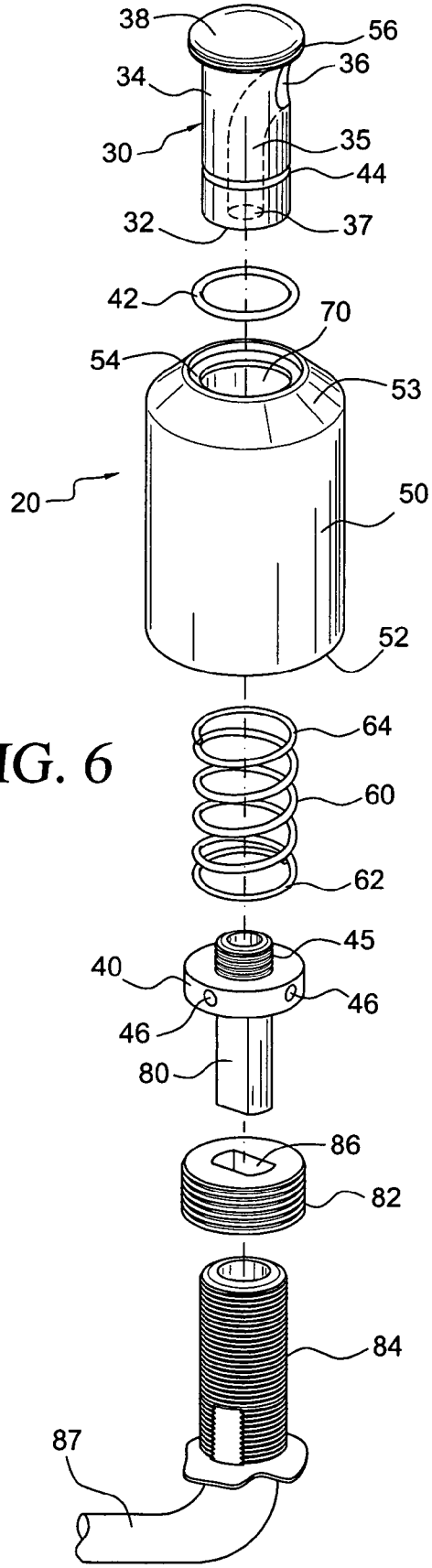
FIG. 6 is an exploded unassembled view showing the pop-up bubbler assembly of the present invention.

The pop-up bubbler assembly 20 is shown in an unassembled exploded view in FIG. 6. In preparation for assembly, the O-ring 42 is slid over the bubbler head 30 and placed within the retaining groove 44. Also, the hollow threaded stud 84 is screwed into the dual threaded retainer 82. Plumber's tape or other appropriate material may be applied to the threads prior to assembly to create a fluid-proof seal when connecting the components.

In assembling the bubbler head 30 and housing 50, the bubbler head 30 is directed through the rim 54 of the central channel 70 in the housing 50. The spring 60 is placed into the lower section 72 of the central channel 70 from the bottom end 52 of the housing 50 where it surrounds the bubbler head 30. Fixing of the spring 60 in position preferably occurs when the second end 64 of the spring 60 abuts with lower rim 75 of the upper section 74 of the central channel 70.

With the spring 60 in place, the bubbler head flange piece 40 is passed into the lower section 72 of the central channel where it is attached to the bubbler head 30 via mating of male threaded section 45 with female threads 37 in the first inlet end 32 of the bubbler head 20. Extending from below the bubbler head flange piece 40 is an alignment tool 80 integrated as a part of the bubbler head flange piece 40 or fixedly attached thereto. The retainer 82 and connected hollow thread stud 84 are slid over the alignment tool 80 at its receiving shaped hole 86 and screwed into the lower section 72 of the central channel 70. The spring 60 retains the bubbler head 30 within the housing 50 until the drinking fountain 10 is activated. Retention within the housing 50 limits exposure to contaminants experienced by other drinking fountains.

While the preferred embodiment has been shown and described, it will be understood that there is no intent to limit the invention by such disclosure, but rather, is intended to cover all modifications and alternate constructions falling within the spirit and scope of the invention.

The invention claimed is:

1. A pop-up bubbler assembly for dispensing a fluid comprising:

a bubbler bead having a longitudinal bore spaced between a first end and a closed second end and the bore having a lateral spout from which fluid is projected, the bubbler head includes a flange piece connected at its first end;

a housing having an upper surface and lower surface and a channel extending therebetween within which the bubbler head is retained to travel between a storage position and an in-use position, the channel includes a first section and a second section, and a cavity positioned between the first section and the second section, the cavity having a diameter larger than that of the second section; and wherein upon activation fluid pressure causes the bubbler head to rise from an opening in the channel at the upper surface of the housing to dispense fluid from the spout, when the flange piece enters the cavity.

2. The pop-up bubbler assembly of claim 1, wherein the bubbler head includes a top cap at the closed second end which cooperates with the opening to form a seal between the housing and bubbler head when the bubbler head is in the storage position.

3. The pop-up bubbler assembly of claim 2, wherein the top cap has a convex upper surface and the housing upper surface is frustoconical, such that the top cap convex upper surface is continuous with the upper surface of the housing so as to form a convex surface preventing the pooling of fluid thereon.

4. The pop-up bubbler assembly of claim 1, wherein the bubbler head includes an O-ring along its length which cooperates with the channel to form a seal when the bubbler head is in its in-use position.

5. The pop-up bubbler assembly of claim 1, wherein the second section has a diameter larger than the diameter of the first section and the bubbler head travels through both said first and second sections.

6. The pop-up bubbler assembly of claim 5, wherein the bubbler head includes a top cap opposite the flange piece, and both the flange piece and the top cap have diameters larger than the first section diameter, thereby preventing entry of the flange piece and the top cap into the first section of the channel.

7. The pop-up bubbler assembly of claim 5, wherein the diameter of the flange piece is larger than said first section diameter, thereby preventing entry of the flange piece into the first section of the channel.

8. The pop-up bubbler assembly of claim 1, wherein the flange piece includes an alignment extension having a shaped circumference.

9. The pop-up bubbler assembly of claim 8, further including a removable retainer for maintaining the flange within the housing of the pop-up bubbler assembly.

10. The pop-up bubbler assembly of claim 9, wherein the retainer includes an alignment extension receiving hole shaped to match the circumference of shaped alignment extension.

11. The pop-up bubbler assembly of claim 10, further including a hollow treaded stud which cooperates with the retainer and is adapted to connected the pop-up bubbler assembly to a fluid supply line.

12. The pop-up bubbler assembly of claim 1, wherein the flange piece includes at least one lateral fluid delivery orifice which is only accessible when the flange piece is position within the cavity.

13. The pop-up bubbler assembly of claim 1, further including a spring positioned between the bubbler head and housing to retain the bubbler head within the housing during inactivation of the assembly.

* * * * *